US010919545B2

(12) United States Patent
Im et al.

(10) Patent No.: US 10,919,545 B2
(45) Date of Patent: Feb. 16, 2021

(54) APPARATUS FOR MONITORING RAILROAD CAR AND MONITORING METHOD USING THE SAME

(71) Applicants: Globiz Co., Ltd., Seoul (KR); Korea Railroad Corporation, Daejeon (KR)

(72) Inventors: Junsik Im, Seoul (KR); Ju-Won Kim, Daejeon (KR)

(73) Assignee: Globiz Co., Ltd., Seoul (KR)

( * ) Notice: Subject to any disclaimer, the term of this patent is extended or adjusted under 35 U.S.C. 154(b) by 101 days.

(21) Appl. No.: 16/303,166

(22) PCT Filed: May 19, 2017

(86) PCT No.: PCT/KR2017/005211
§ 371 (c)(1),
(2) Date: Nov. 20, 2018

(87) PCT Pub. No.: WO2017/204490
PCT Pub. Date: Nov. 30, 2017

(65) Prior Publication Data

US 2019/0232978 A1 Aug. 1, 2019

(30) Foreign Application Priority Data

May 20, 2016 (KR) ..... 10-2016-0062236

(51) Int. Cl.
*B61C 17/12* (2006.01)
*B61K 13/00* (2006.01)
(Continued)

(52) U.S. Cl.
CPC ..... *B61C 17/12* (2013.01); *B61C 17/00* (2013.01); *B61K 9/00* (2013.01); *B61K 9/08* (2013.01);
(Continued)

(58) Field of Classification Search
CPC ..... B61C 17/12
See application file for complete search history.

(56) References Cited

U.S. PATENT DOCUMENTS 7,708,232 B2 * 5/2010 Mace ..... B61F 5/386 246/167 R
2012/0046900 A1 * 2/2012 Baert ..... G01P 15/00 702/141
(Continued)

FOREIGN PATENT DOCUMENTS

JP 2002-053040 2/2002
JP 2007-278894 10/2007
(Continued)

OTHER PUBLICATIONS

Korean International Search Report and the Written Opinion dated Sep. 28, 2017 From the Korean Intellectual Property Office Re. Application No. PCT/KR2017/005211. (13 Pages).

*Primary Examiner* — Peter D Nolan
*Assistant Examiner* — Demetra R Smith-Stewart

(57) ABSTRACT

Disclosed is a method of monitoring a problem related to a railroad car by a railroad car monitoring apparatus, the method including: selecting a monitoring target of the railroad car; selecting a diagnosis reference related to the monitoring target; measuring travelling data related to the monitoring target while the railroad car travels; drawing a result value of the characteristic function according to the travelling data and comparing each of the travelling data with a reference value in a normal state and determining whether a defect is generated in the monitoring target.

10 Claims, 4 Drawing Sheets

(51) Int. Cl.

| | |
|---|---|
| ***B61K 9/08*** | (2006.01) |
| ***B61L 23/04*** | (2006.01) |
| ***B61K 9/00*** | (2006.01) |
| ***B61C 17/00*** | (2006.01) |
| ***B61L 15/00*** | (2006.01) |

(52) U.S. Cl.
CPC ..... *B61K 13/00* (2013.01); *B61L 15/0081* (2013.01); *B61L 23/04* (2013.01); *B61L 23/042* (2013.01)

(56) References Cited

U.S. PATENT DOCUMENTS

| | | | | |
|---|---|---|---|---|
| 2012/0259487 | A1* | 10/2012 | Friesen | B61F 5/245 701/20 |
| 2015/0051792 | A1* | 2/2015 | Kristen | B61L 99/00 701/34.2 |
| 2016/0109476 | A1* | 4/2016 | Foerster | B60T 8/1705 702/142 |
| 2017/0106885 | A1* | 4/2017 | Singh | G01B 11/22 |

FOREIGN PATENT DOCUMENTS

| | | |
|---|---|---|
| JP | 2011-245917 | 12/2011 |
| JP | 2015-023370 | 2/2015 |
| KR | 10-2014-0133635 | 11/2014 |
| WO | WO 2017/204490 | 11/2017 |

* cited by examiner

APPARATUS FOR MONITORING RAILROAD CAR AND MONITORING METHOD USING THE SAME

RELATED APPLICATIONS

This application is a National Phase of PCT Patent Application No. PCT/KR2017/005211 having International filing date of May 19, 2017, which claims the benefit of priority of Korean Patent Application No. 10-2016-0062236 filed on May 20, 2016. The contents of the above applications are all incorporated by reference as if fully set forth herein in their entirety.

FIELD AND BACKGROUND OF THE INVENTION

The present invention relates to an apparatus for monitoring a railroad car and a monitoring method using the same.

A railroad car is considerably influenced by several travelling conditions while travelling. Herein, the travelling condition includes conditions, such as a speed and an acceleration of a car and torque of a motor, determined by an operation of a driver, and conditions, such as a temperature, a wind direction, a wind speed, humidity, the amount of rainfall, a curvature of a track by a position of a car, a pier, and a tunnel, determined by a travelling environment.

Weather related to a temperature, a wind direction, and a wind speed is determined as a factor considerably influencing an operation of a railroad car. When wind having a predetermined speed or larger blows, an operation itself of a railroad car may be inhibited. Further, a railroad car is influenced by humidity, the amount of rainfall, and the like. In a general flow of power in a railroad car, a pantograph receives a high voltage to configure a closed circuit, in which a current flows through a ground railroad, but humidity and the amount of rainfall may act as disturbance in a general flow of electricity and electricity to change an influence on a measurement sensor. Accordingly, a measured physical quantity and a monitoring and diagnosing technology through an analysis of the measured physical quantity exhibiting an excellent characteristic in the interior of the ground are easily useless by the disturbance in an actually travelling railroad car.

Further, in a method of integrally monitoring a main component, travelling stability, and a track of a railroad car, an actual travelling environment cannot be sufficiently considered and the monitoring is performed through a very simplified measurement of a physical quantity, so that there are many cases where reliability of a result of a diagnosis is not sufficiently obtained. Even though a diagnosis is sometimes performed with a single diagnosis item, there are several reasons, so that there is difficulty in presenting an actual solution.

Accordingly, there is a demand for measuring multiple physical quantities, comprehensively and accurately analyzing a diagnosis result, and maximally compressing fundamental reasons, and presenting an actual solution.

SUMMARY OF THE INVENTION

The present invention has been made in an effort to provide an apparatus for monitoring a railroad car, which is capable of monitoring a defect related to a railroad car based on travelling data measured by various sensors related to the railroad car, and a monitoring method using the same.

An exemplary embodiment of the present invention provides method of monitoring a problem related to a railroad car by a railroad car monitoring apparatus, the method including: selecting a monitoring target of the railroad car; selecting a diagnosis reference related to the monitoring target; measuring travelling data related to the monitoring target by using a plurality of different kinds of sensors while the railroad car travels; and comparing each of the travelling data with a reference value in a normal state and determining whether a defect is generated in the monitoring target.

The selecting of the monitoring target may include selecting a monitoring target having high problem reproducibility and a monitoring target having low problem reproducibility according to problem reproducibility.

A problem having the high reproducibility may include damage to a main component mounted to the railroad car, and a problem having the low reproducibility may include bogie instability by transverse vibrations during the travelling of the railroad car or a defect of a track, on which the railroad car travels.

The plurality of different kinds of sensors may include at least two sensors among a vibration sensor, a temperature sensor, a thermal imaging sensor, a position sensor, a speed sensor, an acceleration sensor, an ultrasonic sensor, and a current sensor.

The selecting of the monitoring target may further include setting a characteristic function according to the problem reproducibility for the monitoring target, and the determining of the generation of the defect may include drawing a result value of the characteristic function according to travelling data, comparing the result value with the reference value in the normal state, and determining whether the defect is generated in the monitoring target.

The determining of the generation of the defect in the monitoring target may include measuring travelling data for the same kind of main components mounted to each of a plurality of bogies of the railroad car, comparing a result value of a characteristic function of each of the same kind of main components, and diagnosing whether a problem is generated in the main component.

The determining of the generation of the defect in the monitoring target may include calculating a result value of a characteristic function related to bogie instability in real time for each of a plurality of bogies of the railroad car, comparing the result value for each of the plurality of bogies, and diagnosing whether the bogie instability is generated.

The determining of the generation of the defect in the monitoring target may include comparing a result value of a characteristic function related to the bogie instability with a result value obtained by calculating the characteristic function for a railroad car in a different time zone from a time zone of the railroad car, analyzing a relation for each travelling position of the railroad car, and diagnosing the bogie instability and a track defect at the same time.

Another exemplary embodiment of the present invention provides an apparatus for monitoring a railroad car, the apparatus including: a selecting unit which sets a monitoring target related to a railroad car, and selects a diagnosis reference, based on which a generation of a defect in the monitoring target is diagnosed, and stores the diagnosis reference in a database; a detecting unit which detects travelling data related to the monitoring target by using various sensors while the railroad car travels; and a control unit which compares the travelling data with the diagnosis reference stored in the database and determines whether a defect is generated in the monitoring target in consideration of problem reproducibility.

The monitoring target having the high problem reproducibility may include a main component mounted to the railroad car.

The control unit may measure travelling data for the same kind of main components mounted to each of a plurality of bogies of the railroad car, compare a result value of a characteristic function of each of the same kind of main components, and diagnose whether a problem is generated in the main component.

The monitoring target having the low problem reproducibility may include bogie instability due to transverse vibrations during the travelling of the railroad car or a defect of a track, on which the railroad car travels.

The control unit may calculate a result value of a characteristic function related to bogie instability in real time for each of a plurality of bogies of the railroad car, compare the result value for each of the plurality of bogies, and diagnose whether the bogie instability is generated.

When the bogie instability is repeatedly generated at a specific position of the travelling of the railroad car, the control unit may determine that a defect is generated in a track, on which the railroad car travels.

The present invention selects a monitoring target and a characteristic function in consideration of reproducibility of a problem related to a railroad car and determines whether a defect is generated in the monitoring target based on data measured from various kinds of sensors, thereby providing an environment, in which it is possible to detect a problem related to the railroad car in an early stage.

Further, the present invention detects a defect of a main component of a railroad car, bogie instability, a track defect, and the like in an early stage, thereby preventing an accident due to the generation of the defect of the main component of the car and providing an environment for safely protecting a passenger.

BRIEF DESCRIPTION OF THE SEVERAL VIEW OF THE DRAWINGS

DESCRIPTION OF SPECIFIC EMBODIMENTS OF THE INVENTION

Figure 1:
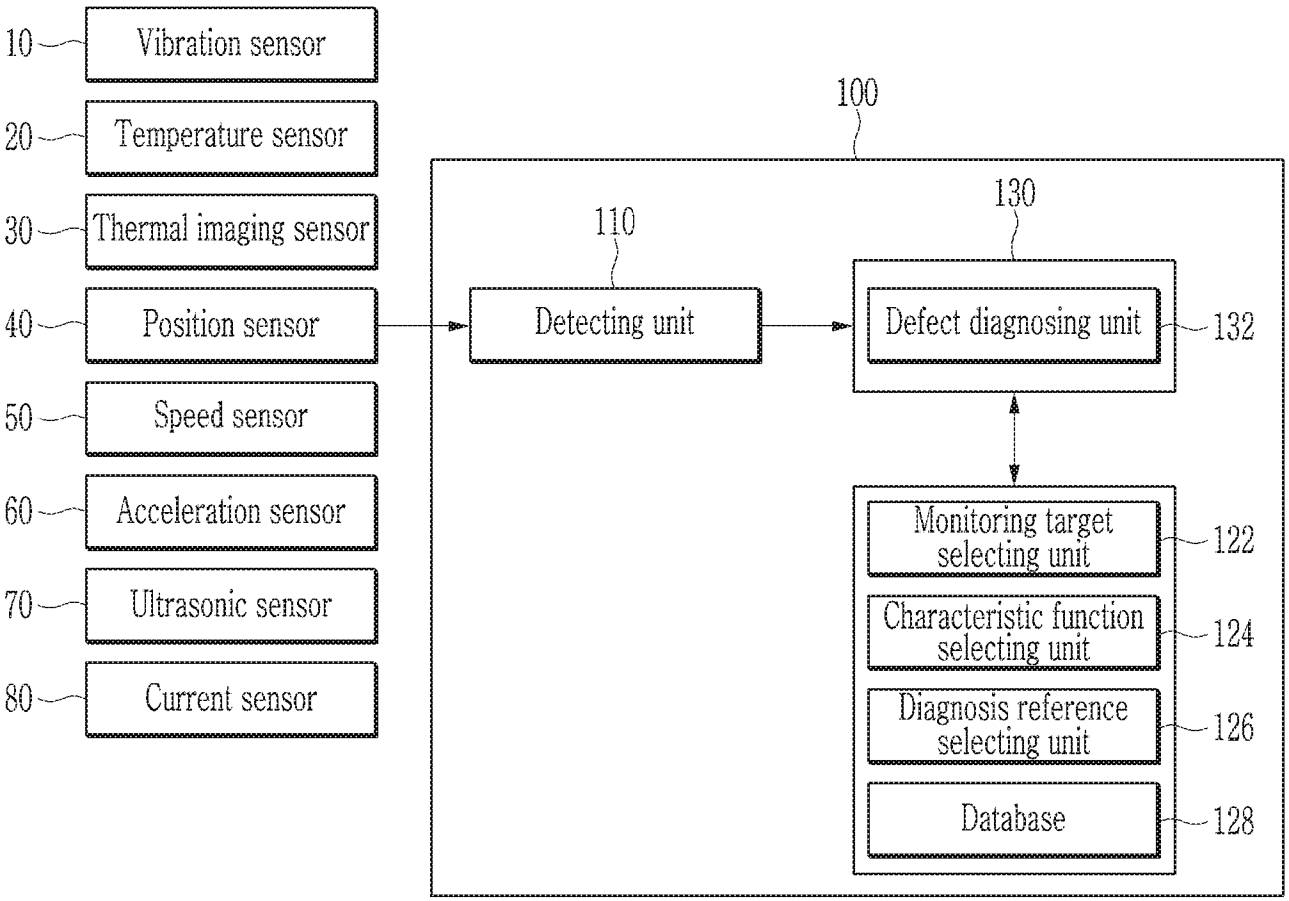
FIG. 1 is a diagram schematically illustrating a structure of a railroad car monitoring apparatus according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout the specification, unless explicitly described to the contrary, the word "comprise" and variations such as "comprises" or "comprising", will be understood to imply the inclusion of stated elements but not the exclusion of any other elements.

Like reference numerals designate like elements throughout the specification. In addition, the terms "unit", "module", and the like described in the specification mean units for processing at least one function and operation and can be implemented by hardware components or software components and combinations thereof.

Hereinafter, a railroad car monitoring apparatus according to an exemplary embodiment of the present invention and a monitoring method using the same will be described in detail with reference to FIGS. 1 to 4.

FIG. 1 is a diagram schematically illustrating a structure of a railroad car monitoring apparatus according to an exemplary embodiment of the present invention. In this case, only the schematic configuration of the railroad car monitoring apparatus required for description according to the exemplary embodiment of the present invention is illustrated, and the present invention is not limited to the configuration.

Referring to FIG. 1, the railroad car monitoring apparatus 100 according to the exemplary embodiment of the present invention includes a detecting unit 110, a selecting unit 120, and a control unit 130.

The detecting unit 110 detects travelling data related to a monitoring target by using various sensors while a railroad car travels. Herein, the monitoring target includes a main component mounted to a railroad car, bogie instability by transverse vibration during the travelling of a railroad car, a track, on which a railroad car travels, and the like. Then, the travelling data includes data related to a travelling environment of a railroad car, and may include at least one of a travelling speed, an acceleration, a travelling position, a temperature, a vibration value, and a current value of the railroad car, a wind direction, a wind speed, humidity, and the amount of rainfall.

For example, the detecting unit 110 measures various physical quantities related to the monitoring through a vibration sensor 10, a temperature sensor 20, a thermal imaging sensor 30, a position sensor 40, a speed sensor 50, an acceleration sensor 60, an ultrasonic sensor 70, and a current sensor 80, and provides the measured data to the control unit 130.

The selecting unit 120 sets a monitoring target related to the railroad car, and selects a diagnosis reference, based on which the generation of a defect in the monitoring target is diagnosed, and stores the diagnosis reference in a database.

The selecting unit 120 includes a monitoring target selecting unit 122, a characteristic function selecting unit 124, a diagnosis reference selecting unit 126, and a database 128 according to the exemplary embodiment of the present invention.

The monitoring target selecting unit 122 selects a monitoring target having high problem reproducibility and a monitoring target having low problem reproducibility according to problem reproducibility. Herein, the monitoring target having high problem reproducibility includes damage to a main component mounted to the railroad car. Further, the monitoring target having low problem reproducibility may include bogie instability by transverse vibration during the travelling of the railroad car or a defect of a track, on which the railroad car travels.

The characteristic function selecting unit 124 selects a characteristic function, by which whether the monitoring target has a problem is analyzed. In this case, the characteristic function is a function for determining damage to the main component of the railroad car, bogie instability, or track integrity, and is a function formed of parameters related to a travelling condition and a travelling environment of the railroad car. Further, the characteristic function may include at least one of a vibration characteristic function, a temperature change characteristic function, a torsion characteristic function, and a current characteristic function.

The diagnosis reference selecting unit 126 sets a diagnosis reference for determining whether the monitoring target has a defect, and stores the set diagnosis reference in the database 128.

The control unit 130 draws a result value of the characteristic function by using the travelling data detected by the detecting unit 110, and compares the result value with a reference value in a normal state and determines whether the corresponding monitoring target has a defect.

Further, the control unit 130 may compare the travelling data and the result value of the characteristic function with the diagnosis reference stored in the database 128, and determine whether the monitoring target has a defect.

The control unit 130 includes a defect diagnosing unit 132 according to the exemplary embodiment of the present invention.

The defect diagnosing unit 132 draws a result value of the characteristic function according to the travelling data, and compares the drawn result value with a reference value in a normal state and determines whether the monitoring target has a defect.

The railroad car monitoring apparatus 100 according to the exemplary embodiment of the present invention measures travelling data for the same kind of main components mounted to the plurality of bogies of the railroad car, respectively, and compares a result value of a characteristic function of each of the same kind of main components and diagnoses whether the main component has a problem.

Further, the railroad car monitoring apparatus 100 according to the exemplary embodiment of the present invention may calculate a result value of a characteristic function related to bogie instability for each of the plurality of bogies of the railroad car in real time, and compare the result value of each of the plurality of bogies and diagnose whether the bogie instability is generated.

Further, the railroad car monitoring apparatus 100 according to the exemplary embodiment of the present invention may also compare a result value of a characteristic function related to bogie instability with a result value obtained by calculating the characteristic function for a railroad car in a different time zone from that of the railroad car, analyze a relation for each travelling position of the railroad car, and diagnose the bogie instability and a track defect at the same time.

In order to achieve the object, the control unit 130 may be implemented with one or more processors operated by a set program, and the set program may be programmed so as to perform each operation of a method of monitoring a railroad car according to an exemplary embodiment of the present invention.

Figure 2:
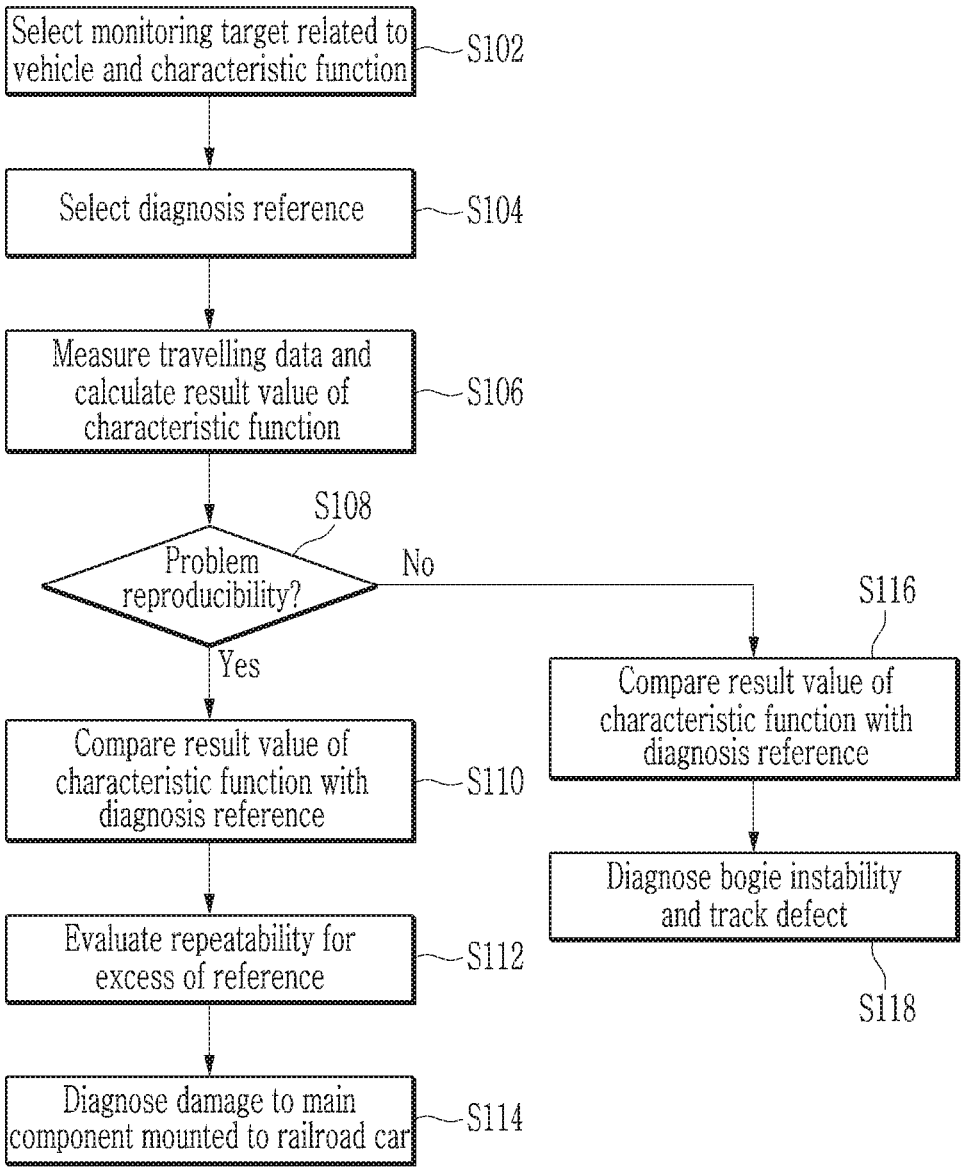
FIG. 2 is a flowchart schematically illustrating a process of monitoring a problem related to a railroad car according to an exemplary embodiment of the present invention.

FIG. 2 is a flowchart schematically illustrating a process of monitoring a problem related to a railroad car according to an exemplary embodiment of the present invention. The flowchart below will be described by using the same reference numeral in connection with the configuration of FIG. 1.

Referring to FIG. 2, the railroad car monitoring apparatus 100 according to the exemplary embodiment of the present invention selects a monitoring target related to a railroad car in consideration of problem reproducibility, and selects a characteristic function related to the corresponding monitoring target (S102). Herein, the monitoring target having high problem reproducibility includes damage to a main component mounted to the railroad car. Further, the monitoring target having low problem reproducibility may include bogie instability by transverse vibration during the travelling of the railroad car or a defect of a track, on which the railroad car travels.

Further, the railroad car monitoring apparatus 100 according to the exemplary embodiment of the present invention selects a diagnosis reference, based on which a defect in the monitoring target is determined, and stores the diagnosis reference in a database (S104).

Then, the railroad car monitoring apparatus 100 according to the exemplary embodiment of the present invention measures a travelling data of the railroad car, and calculates a result value of the characteristic function by using the measured travelling data (S106). Herein, the travelling data includes at least one of a travelling speed, an acceleration, a travelling position, a temperature, a vibration value, a current value of the railroad car, a wind direction, a wind speed, humidity, and the amount of rainfall.

Further, when problem reproducibility is high, the railroad car monitoring apparatus 100 according to the exemplary embodiment of the present invention compares the result value of the characteristic function with the diagnosis reference of the database, evaluates repeatability for excess of the reference, and diagnoses damage to the main component mounted to the railroad car (S108 to S114).

Then, when problem reproducibility is low, the railroad car monitoring apparatus 100 according to the exemplary embodiment of the present invention compares the result value of the characteristic function with the diagnosis reference in real time and diagnoses bogie instability and a track defect (S118).

Figure 3:
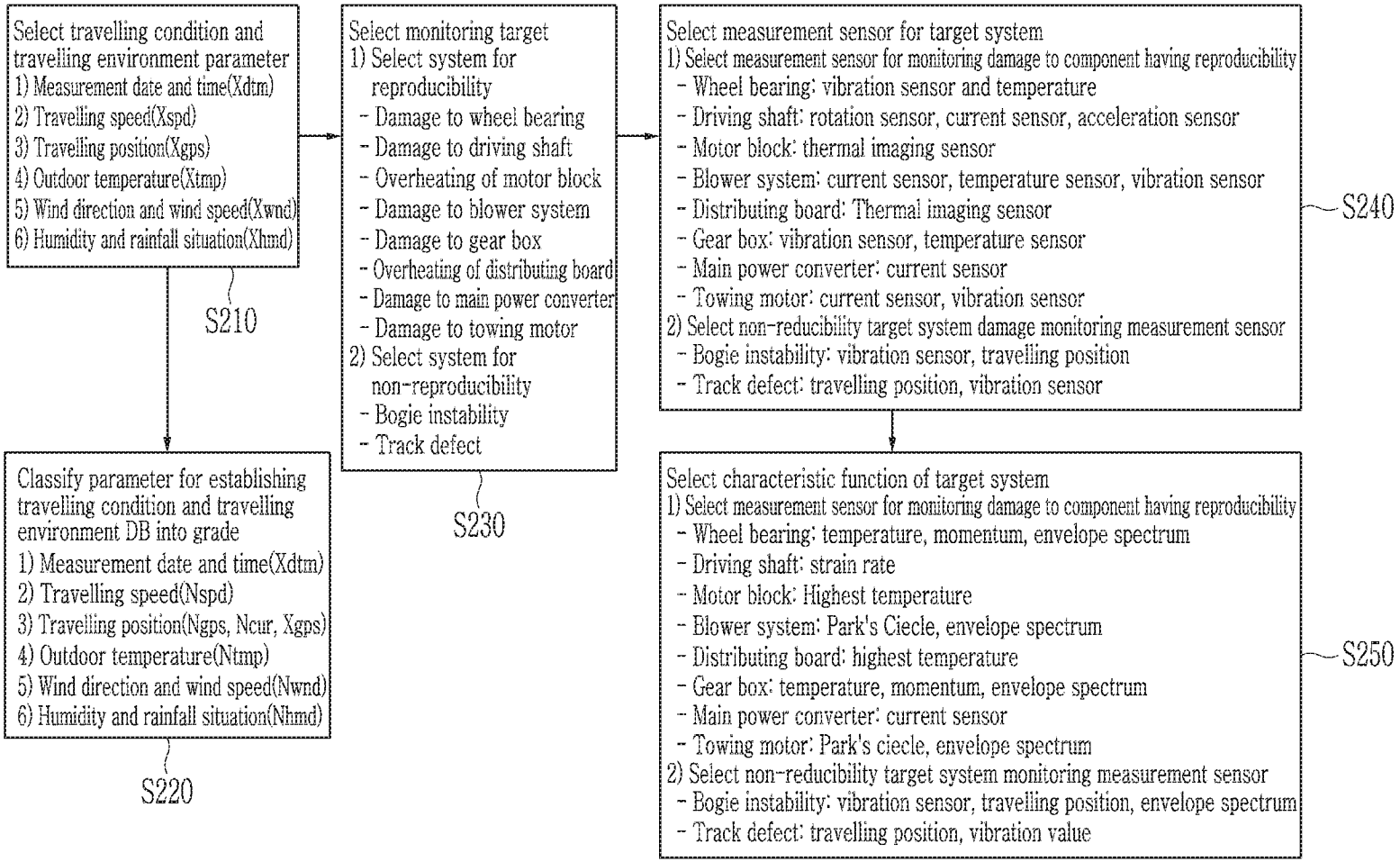
FIG. 3 is a diagram illustrating an example of selecting a monitoring target and a characteristic function according to an exemplary embodiment of the present invention.

FIG. 3 is a diagram illustrating an example of selecting a monitoring target and a characteristic function according to an exemplary embodiment of the present invention.

Referring to FIG. 3, in order to monitor damage to the main component of the railroad car, the generation of bogie instability, and a track defect, the railroad car monitoring apparatus 100 according to the exemplary embodiment of the present invention measures travelling data of the car, makes the measured travelling data into a parameter, and classifies the travelling data parameter based on a class (S210 and S220). Herein, the parameter includes a measurement date and time (Xdtm), a travelling speed (Xspd), a travelling position (Xgps), an outdoor temperature (Xtmp), a wind direction and speed (Xwnd), humidity and rainfall situation (Xhmd), and the like.

For example, the railroad car monitoring apparatus 100 according to the exemplary embodiment of the present invention classifies each of a speed, a position, and a temperature into grade, and establishes a DB related to the travelling data measured for each parameter and a result value of a characteristic function for the corresponding travelling data.

Then, the railroad car monitoring apparatus 100 according to the exemplary embodiment of the present invention sets a monitoring target having high reproducibility and a monitoring target having low reproducibility according to problem reproducibility (S230). For example, the monitoring target having high problem reproducibility includes damage to a wheel bearing, damage to a driving shaft, overheating of a motor block, damage to a blower system, overheating of a distributing board, damage to a gear box, damage to a main power converter, damage to a tow motor of the railroad car, and the like. Further, the monitoring target having low problem reproducibility includes bogie instability, a track defect, and the like.

Further, the railroad car monitoring apparatus 100 according to the exemplary embodiment of the present invention sets a measurement sensor, which is to measure travelling data for each monitoring target (S240). For example, in order to monitor a defect of a wheel bearing, a vibration sensor and a temperature sensor may be set as the measurement sensors, and in order to monitor a defect of the distributing board, a temperature sensor may be set as the measurement sensor. Further, in order to monitor bogie instability and a track defect, a vibration sensor and a sensor related to a travelling position may be set as the measurement sensors.

Further, the railroad car monitoring apparatus 100 according to the exemplary embodiment of the present invention sets a characteristic function, with which a defect of each monitoring target is diagnosed (S250). For example, in order to diagnose a defect of a wheel bearing, the railroad car monitoring apparatus 100 according to the exemplary embodiment of the present invention sets a temperature characteristic function and a vibration characteristic function related to momentum and an envelope spectrum. In order to monitor a defect of the distributing board, the railroad car monitoring apparatus 100 according to the exemplary embodiment of the present invention sets a temperature change characteristic function related to the highest temperature. Further, in order to monitor a defect of bogie instability, the railroad car monitoring apparatus 100 according to the exemplary embodiment of the present invention may set a vibration characteristic function related to a vibration value and an envelope spectrum.

Figure 4:
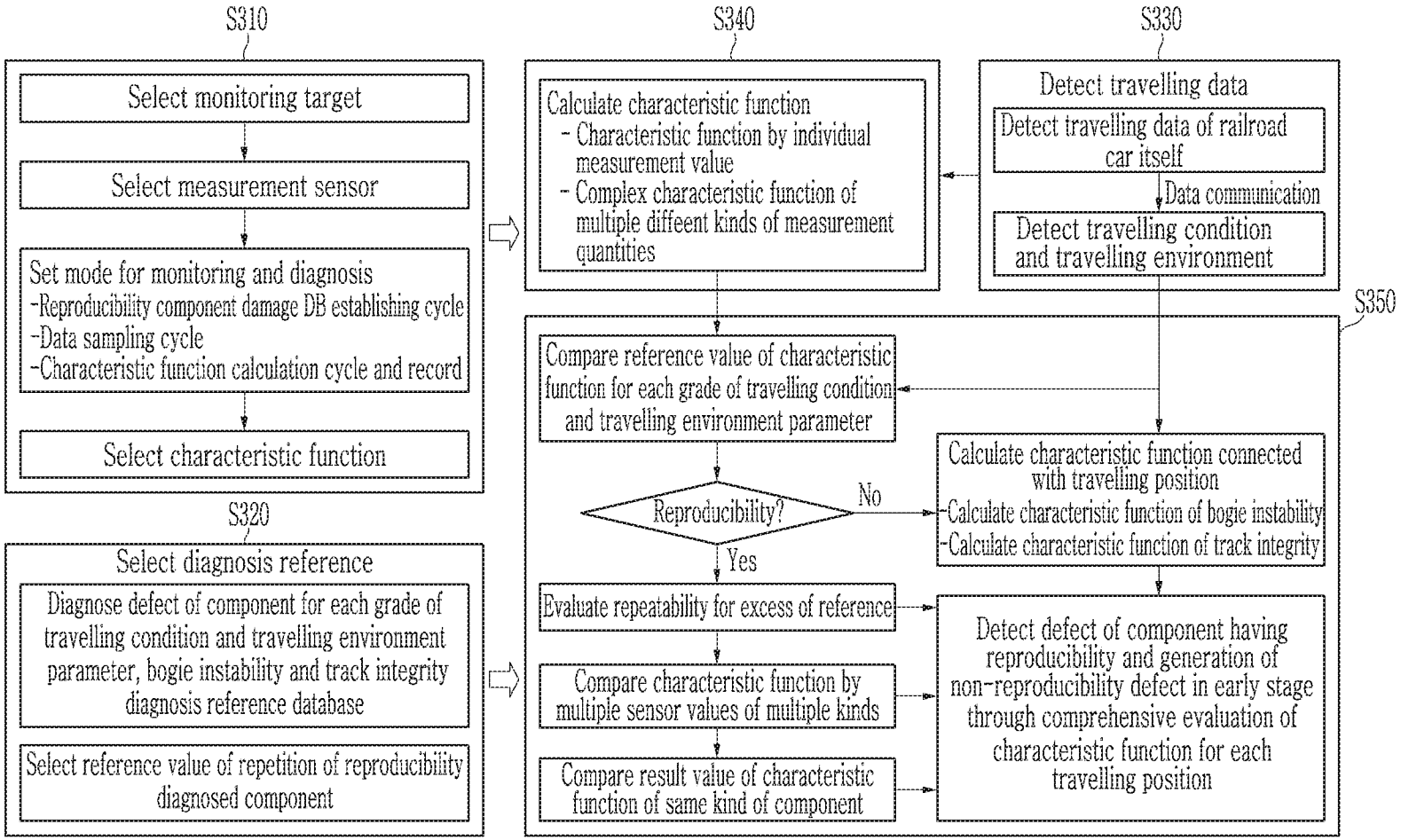
FIG. 4 is a diagram illustrating a process of monitoring a problem related to a railroad car according to an exemplary embodiment of the present invention in detail.

FIG. 4 is a diagram illustrating a process of monitoring a problem related to a railroad car according to an exemplary embodiment of the present invention in detail.

Referring to FIG. 4, the railroad car monitoring apparatus 100 according to the exemplary embodiment of the present invention sets a monitoring target, of which a defect is to be detected, and a measurement sensor, and selects a characteristic function related to the corresponding monitoring target (S310).

Further, the railroad car monitoring apparatus 100 according to the exemplary embodiment of the present invention selects a diagnosis reference, based on which a defect in the monitoring target is to be determined (S320).

Further, the railroad car monitoring apparatus 100 according to the exemplary embodiment of the present invention detects travelling data related to a travelling condition and a travelling environment, calculates a result value of the characteristic function based on the detected travelling data, and detects the generation of the defect in consideration of problem reproducibility for the monitoring target (S330 to S350).

Herein, the characteristic function may include at least one of a vibration characteristic function, a temperature change characteristic function, a torsion characteristic function, and a current characteristic function according to the exemplary embodiment of the present invention.

Further, the vibration characteristic function related to a vibration sensor includes at least one of a root mean square acceleration (RMSA), peak, skewness, kurtosis, a crest factor, an impulse factor, a shape factor, and a spectrum value of a defect frequency, which are expressed by Equations 1 to 8.

$$\mathrm{RMS} = \sqrt{\frac{1}{n}\sum_{i=1}^{N}(x(i)-\bar{x})^2} \quad \text{(Equation 1)}$$

$$\mathrm{peak} = \frac{1}{2}(\max(x(t)) - \min(x(t))) \quad \text{(Equation 2)}$$

$$\mathrm{Skewness} = \frac{\frac{1}{N}\sum_{i=1}^{N}(x(i)-\bar{x})^4}{\mathrm{RMS}^4} \quad \text{(Equation 3)}$$

$$CrestFactor = \frac{\mathrm{peak}}{\mathrm{RMS}} \quad \text{(Equation 4)}$$

$$\mathrm{Kurtosis} = \frac{\frac{1}{N}\sum_{i=1}^{N}(x(i)-\bar{x})^4}{\mathrm{RMS}^4} \quad \text{(Equation 5)}$$

$$ClearFactor = \frac{\mathrm{peak}}{\frac{1}{N}\left(\sum_{i=1}^{N}\sqrt{|x(i)|}\right)^2} \quad \text{(Equation 6)}$$

$$ImpulseFactor = \frac{\mathrm{peak}}{\frac{1}{N}\sum_{i=1}^{N}|x(i)|} \quad \text{(Equation 7)}$$

$$ShapeFactor = \frac{\mathrm{RMS}}{\frac{1}{N}\sum_{i=1}^{N}|x(i)|} \quad \text{(Equation 8)}$$

Herein, x(i) is an acceleration measurement value, $\bar{x}$ includes an average value, RMSA indicates a calculation value of an RMS for an acceleration, and peak indicates a maximum amplitude of a given section in a high frequency signal waveform.

Further, skewness indicates a yardstick indicating the degree of a bias of an actual probability distribution of a random variable with respect to an average value, and a crest factor indicates a ratio of a peak to an average value as a yardstick of a waveform, such as an alternating current or a sound.

Further, kurtosis indicates one yardstick of a probability distribution of a random variable to a peak size, and a clearance factor is a factor for detecting initial spalling of a bearing by fatigue.

Further, an impulse factor is one dimensionless amplitude parameter and is a useful method under a simulation condition using a Gaussian probability density function model of the bearing spalling due to fatigue, and a shape factor is another dimensionless amplitude parameter and is a useful method under a simulation condition using a Gaussian probability density function model of the bearing spalling due to fatigue.

For example, the railroad car monitoring apparatus 100 according to the exemplary embodiment of the present invention classifies a travelling condition and a travelling environment as parameters for the wheel bearing, and when a result value of only one of the two characteristic functions including a characteristic function of a vibration sensor value and a characteristic function of a temperature sensor value exceeds a reference value in the classified category, the railroad car monitoring apparatus 100 according to the exemplary embodiment of the present invention primarily determines that there is a possibility that a defect is generated.

Further, the railroad car monitoring apparatus 100 according to the exemplary embodiment of the present invention compares the characteristic function with a characteristic function of another wheel bearing within the bogie, and when there is a sufficient relative difference and the phenomenon repeatedly continues, the railroad car monitoring apparatus 100 according to the exemplary embodiment of the present invention may finally diagnose that the defect is generated.

Further, the temperature change characteristic function includes a maximum value of the temperature sensor, and a diagnosis reference using permissible tolerance and a temperature limit is expressed by Equation 9 below.

$$T_{max} > T_f + \beta \quad \text{(Equation 9)}$$

$T_f$: Temperature limit

β: Permissible temperature tolerance

Further, the temperature characteristic function means the case where a result value is the largest among the temperature values of the pixels when a temperature of a broad area is measured by a pixel, like a thermal imaging sensor.

In the railroad car monitoring apparatus 100 according to the exemplary embodiment of the present invention, a plurality of thermal imaging sensors is attached to motor blocks of a tow vehicle of the railroad car and the distributing boards of a passenger car, and when the highest temperature by the temperature change characteristic function exceeds a diagnosis reference value, the railroad car monitoring apparatus 100 according to the exemplary embodiment of the present invention primarily determines that there is a possibility that a defect is generated.

Further, the railroad car monitoring apparatus 100 according to the exemplary embodiment of the present invention compares the diagnosis reference value with the highest temperature of each of an adjacent motor block and the distributing board, and when the phenomenon of the excess of the diagnosis reference value repeatedly continues, the railroad car monitoring apparatus 100 according to the exemplary embodiment of the present invention may finally diagnose that the defect is generated in the motor block or the distributing board.

Further, the torsion characteristic function is expressed by Equation 10 below.

$$\theta = \theta_1 - \theta_2 \text{ at } \Sigma(T_1 + T_2) \quad \text{(Equation 10)}$$

Herein, θ is torsion strain, $\theta_1$ and $\theta_2$ indicate encoder rotation angles, and $T_1$ and $T_2$ indicate driving torque and brake torque.

The railroad car monitoring apparatus 100 according to the exemplary embodiment of the present invention may diagnose a defect of a power transmission device of the railroad car by using the torsion function.

Further, the railroad car monitoring apparatus 100 according to the exemplary embodiment of the present invention measures each of three-phase current waveforms of the main power converter by using a current sensor, and draws a characteristic function for roundness as expressed by Equation 11 below.

$$I_d = \sqrt{\frac{2}{3}}\, I_a - \frac{1}{\sqrt{6}} I_b - \frac{1}{\sqrt{6}} I_c \quad \text{(Equation 11)}$$

-continued $$I_q = \frac{1}{\sqrt{2}} I_b - \frac{1}{\sqrt{2}} I_c$$

$$R_f - \alpha < I_d^2 + I_q^2 = R < R_f + \alpha$$

Then, the railroad car monitoring apparatus 100 according to the exemplary embodiment of the present invention may check a defect of the main component based on whether roundness $I_d$ and $I_q$ by Equation 11 exist within permissible tolerance in a reference value $R_f$.

Further, the railroad car monitoring apparatus 100 according to the exemplary embodiment of the present invention generally measures a low frequency signal within 10 Hz by using a transverse vibration sensor mounted to the bogie for detecting the generation of bogie instability, and monitors whether a specific vibration value continues for a specific time in real time.

Further, when the bogie instability is highly related to a specific travelling position and continues in another bogie and another organized car, the railroad car monitoring apparatus 100 according to the exemplary embodiment of the present invention may diagnose that a defect is generated in integrity of the track.

As described above, the railroad car monitoring apparatus according to the exemplary embodiment of the present invention sets a monitoring target and a characteristic function in consideration of reproducibility of a problem related to a railroad car and determines whether a defect is generated in the monitoring target based on data measured from various sensors, thereby providing an environment, in which it is possible to detect a problem related to the railroad car in an early stage.

Further, the present invention detects a defect of a main component of a railroad car, bogie instability, a track defect, and the like in an early stage, thereby preventing an accident due to the generation of the defect of the main component of the car and providing an environment for safely protecting a passenger.

The exemplary embodiment of the present invention described above is not implemented only by the apparatus and the method, and may also be implemented by a program executing a function corresponding to the configuration of the exemplary embodiment of the present invention or a recording medium, in which the program is recorded.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method of monitoring a problem related to a railroad car by a railroad car monitoring apparatus, the method comprising:

selecting a monitoring target of the railroad car;

selecting a diagnosis reference related to the monitoring target;

measuring travelling data related to the monitoring target by using a plurality of different kinds of sensors while the railroad car travels; and comparing each of the travelling data with a reference value in a normal state and determining whether a defect is generated in the monitoring target, wherein the selecting of the monitoring target includes: selecting a monitoring target having high problem reproducibility and a monitoring target having low problem reproducibility according to problem reproducibility; and setting a characteristic function according to the monitoring target;

wherein the determining of the generation of the defect in the monitoring target includes:

determining of the generation of the defect in the monitoring target having high problem reproducibility by comparing a result value of the characteristic function with the reference value in the normal state, evaluating repeatability for excess of the reference, and determining of the generation of the defect in the monitoring target having low problem reproducibility by comparing a result value of the characteristic function with the reference value in the normal state in real time.

2. The method of claim 1, wherein:

a problem having the high reproducibility includes damage to a main component mounted to the railroad car, and a problem having the low reproducibility includes bogie instability by transverse vibrations during the travelling of the railroad car or a defect of a track, on which the railroad car travels.

3. The method of claim 2, wherein:

the plurality of sensors having the different kinds includes at least two sensors among a vibration sensor, a temperature sensor, a thermal imaging sensor, a position sensor, a speed sensor, an acceleration sensor, an ultrasonic sensor, and a current sensor.

4. The method of claim 1, wherein:

the determining of the generation of the defect in the monitoring target includes measuring travelling data for the same kind of main components mounted to each of a plurality of bogies of the railroad car, comparing a result value of a characteristic function of each of the same kind of main components, and diagnosing whether a problem is generated in the main component.

5. The method of claim 1, wherein:

the determining of the generation of the defect in the monitoring target includes comparing a result value of a characteristic function related to the bogie instability with a result value obtained by calculating the characteristic function for a railroad car in a different time zone from a time zone of the railroad car, analyzing a relation for each travelling position of the railroad car, and diagnosing the bogie instability and a track defect at the same time.

6. An apparatus for monitoring a railroad car, the apparatus comprising:

a selecting unit which sets a monitoring target related to a railroad car, and selects a diagnosis reference, based on which a generation of a defect in the monitoring target is diagnosed, and stores the diagnosis reference in a database;

a detecting unit which detects travelling data related to the monitoring target by using various sensors while the railroad car travels; and a control unit which compares the travelling data with the diagnosis reference stored in the database and determines whether a defect is generated in the monitoring target in consideration of problem reproducibility;

wherein the selecting unit selects a monitoring target having high problem reproducibility and a monitoring target having low problem reproducibility according to problem reproducibility, and sets a characteristic function according to the monitoring target, and wherein the control unit determines the generation of the defect in the monitoring target having high problem reproducibility by comparing a result value of the characteristic function with the reference value in the normal state, and evaluating repeatability for excess of the reference; and the control unit determines the generation of the defect in the monitoring target having low problem reproducibility by comparing a result value of the characteristic function with the reference value in the normal state in real time.

7. The apparatus of claim 6, wherein:

the monitoring target having the high problem reproducibility includes a main component mounted to the railroad car.

8. The apparatus of claim 7, wherein:

the control unit measures travelling data for the same kind of main components mounted to each of a plurality of bogies of the railroad car, compares a result value of a characteristic function of each of the same kind of main components, and diagnoses whether a problem is generated in the main component.

9. The apparatus of claim 6, wherein:

the monitoring target having the low problem reproducibility includes bogie instability by transverse vibrations during the travelling of the railroad car or a defect of a track, on which the railroad car travels.

10. The apparatus of claim 9, wherein:

the control unit calculates a result value of a characteristic function related to bogie instability in real time for each of a plurality of bogies of the railroad car, compares the result value for each of the plurality of bogies, and diagnoses whether the bogie instability is generated.

* * * * *